US010974936B2

(12) United States Patent
Verkoyen et al.

(10) Patent No.: US 10,974,936 B2
(45) Date of Patent: Apr. 13, 2021

(54) HYDRAULIC CONTROLLER FOR HYDRAULICALLY ACTUATED LIFTABLE AND LOWERABLE HOOK OF CRANE

(71) Applicant: XCMG EUROPEAN RESEARCH CENTER GMBH, Krefeld (DE)

(72) Inventors: Torsten Verkoyen, Brueggen (DE); Heinz Henning Hoppmann, Krefeld (DE); Christian Stammen, Korschenbroich (DE)

(73) Assignee: XCMG European Research Center GmbH, Krefeld (DE)

( * ) Notice: Subject to any disclaimer, the term of this patent is extended or adjusted under 35 U.S.C. 154(b) by 282 days.

(21) Appl. No.: 15/754,421

(22) PCT Filed: Aug. 16, 2016

(86) PCT No.: PCT/EP2016/069399
§ 371 (c)(1),
(2) Date: Feb. 22, 2018

(87) PCT Pub. No.: WO2017/032641
PCT Pub. Date: Mar. 2, 2017

(65) Prior Publication Data

US 2018/0257915 A1 Sep. 13, 2018

(30) Foreign Application Priority Data

Aug. 25, 2015 (EP) ..... 15182321

(51) Int. Cl.
*B66C 13/20* (2006.01)
*B66D 1/44* (2006.01)
(Continued)

(52) U.S. Cl.
CPC ..... *B66C 13/20* (2013.01); *B66C 23/54* (2013.01); *B66D 1/08* (2013.01); *B66D 1/44* (2013.01);
(Continued)

(58) Field of Classification Search
CPC ..... B66D 5/26; B66D 5/28; B66D 1/44
(Continued)

(56) References Cited

U.S. PATENT DOCUMENTS 3,173,550 A * 3/1965 Province ..... B66C 13/18 212/285
10,359,063 B2 * 7/2019 Shan ..... B66C 13/12
(Continued)

FOREIGN PATENT DOCUMENTS

DE 102008064136 A1 1/2010
GB 2083164 A * 3/1982 ..... B66D 5/026
(Continued)

OTHER PUBLICATIONS

JP 2001089079 A machine translation to English (Year: 2001).*
JP H11199181 A machine translation to English (Year: 1999).*

*Primary Examiner* — Nathaniel E Wiehe
*Assistant Examiner* — Michael Quandt
(74) *Attorney, Agent, or Firm* — Berenato & White, LLC

(57) ABSTRACT

A hydraulically actuated liftable and lowerable hook of a crane has a hydraulic system comprises at least one working machine with a hydraulic motor driving a winch. At least one drive machine comprising a pump is connected directly or indirectly to at least one of the working machines by means of two connections via corresponding working lines, which serve as a feed or return depending on the operating state of the working machine. A lowering brake valve is provided in one working line and is connected to the other working line via a control line such that the lowering brake
(Continued)

valve is displaceable against a restoring force by pressure, which prevails in the other working line and is forwarded via the control line, from the blocking position of said valve into a through-flow position for lowering the hook by means of a primary winch.

16 Claims, 7 Drawing Sheets

(51) Int. Cl.

| | |
|---|---|
| ***B66D 1/08*** | (2006.01) |
| ***B66D 5/26*** | (2006.01) |
| ***B66C 23/00*** | (2006.01) |
| ***F15B 11/044*** | (2006.01) |

(52) U.S. Cl.
CPC ..... *B66D 5/26* (2013.01); *F15B 11/044* (2013.01); *B66C 2700/0357* (2013.01); *B66D 2700/0133* (2013.01)

(58) Field of Classification Search
USPC ..... 254/361, 391; 60/905
See application file for complete search history.

(56) References Cited

U.S. PATENT DOCUMENTS

| | | | |
|---|---|---|---|
| 2012/0285152 | A1 | 11/2012 | Sugano et al. |
| 2013/0311051 | A1 | 11/2013 | Torii |

FOREIGN PATENT DOCUMENTS

| | | | | |
|---|---|---|---|---|
| JP | 11199181 | A | * | 7/1999 |
| JP | 2001089079 | A | * | 4/2001 |
| JP | 2004292102 | A | | 10/2004 |

* cited by examiner

HYDRAULIC CONTROLLER FOR HYDRAULICALLY ACTUATED LIFTABLE AND LOWERABLE HOOK OF CRANE

CROSS-REFERENCE TO RELATED APPLICATIONS AND CLAIM TO PRIORITY

This application is a national stage application of International Application No. PCT/EP2016/069399, filed Aug. 16, 2016, which claims priority to European Patent Application No. 15182321.8 filed Aug. 25, 2015, the disclosures of which are incorporated herein by reference and to which priority is claimed.

FIELD OF THE INVENTION

The invention relates to a hydraulic controller for a hydraulically actuated liftable and lowerable hook of a crane, wherein the hydraulic system comprises at least one working machine, which is designed as a hydraulic motor and drives the winch, and at least one drive machine, which is designed, in particular, as a pump, wherein the working machine is connected directly or indirectly to at least one of the drive machines by means of two connections via corresponding working lines, which connections serve as a feed or return depending of the operating state of the working machine, and wherein a lowering brake valve is provided in one working line and is connected to the other working line via a control line in such a way that the lowering brake valve is displaceable against a restoring force by the pressure, which prevails in the other working line and is forwarded via the control line, from the blocking position of said valve into a through-flow position for lowering the hook by means of the winch, in particular a primary winch.

BACKGROUND OF THE INVENTION

Such hydraulic controllers in which a hydraulic resistor in the control line and a hydraulic resistor in the outflow line determine the opening pressure of the lowering brake valve are known from practice. A disadvantage here is that a targeted control of the lowering is thus not possible. Either the lowering takes place securely, but slowly, or there is the risk of vibrations and/or cavitation in the case of excessively large lowering, depending on the design of the hydraulic resistors.

SUMMARY OF THE INVENTION

It is an object of the invention to avoid the aforementioned disadvantages and to specify a hydraulic controller by means of which the risk of unstable states is reduced or even avoided.

This object is achieved in that an outflow line leading back to a tank branches off from the control line, wherein, for an adjustment of the control pressure acting on the lowering brake valve to different values, the outflow line is provided with a switching possibility, by means of which the effective hydraulic resistance in the outflow line can be changed to at least two different values by open-loop or closed-loop control.

Examples of hydraulic resistors which come into consideration are orifice plates, throttles or mixed forms.

For an adjustment of the control pressure acting on the lowering brake valve to different values, the control line can be provided with a switch between internal and external control. Here, the signal of the external control can be limited in such a way that complete opening of the lowering brake valve is not possible.

A fraction of the pressure is channeled away through the outflow line leading back to the tank, with the result that the pressure acting on the lowering brake valve is reduced by this fraction. If the two parallel hydraulic resistors, in particular orifice plates, are operated simultaneously in the outflow line leading back to the tank, a greater feed-through results, with the result that the pressure acting on the lowering brake valve is reduced and the lowering proceeds more slowly.

With the external control activated, the pressure feedback in the drive machine/pump remains constant and the latter continues in its basic state, which can be, for example, about 30 bar. In this respect, a switch between secured fine control and standard switching can be achieved. A fine control is thus also possible if no block and tackle is present and thus the lowering travel is proportional to the rotational speed of the working machine.

The working line which serves as a feed during the prevailing operating state of the working machine can preferably be loaded with a volumetric flow which controls the working speed and which can be changed at least in certain operating states via a gas pedal and/or a joystick. Furthermore, a control line can connect the working line which serves as a return during the prevailing operating state of the working machine to the switching possibility for loading the loading the switching possibility by the back pressure which, on account of the line resistance, results in the working line which serves as a return during the prevailing operating state of the working machine.

Alternatively, a different open-loop or closed-loop control is also possible, such as, for example, an active, for example electric, control. Here, the switching possibility can also be actuated in dependence on the valve path of the lowering brake valve. The coupling can be arbitrary, for example mechanical, hydraulic or in some other form.

The switching possibility can also be configured as a combined component and comprise a switchable hydraulic resistor, in particular an orifice plate.

According to the invention, the value of the smaller hydraulic resistance can be 0.66 times or 0.85 times the value of the larger hydraulic resistance or the diameter of the smaller orifice plate can be about 0.66 times or 0.85 times the diameter of the larger orifice plate. As a departure, however, all ratio values from 0 to 1 are possible.

Furthermore, for the switch between internal and external control of the control pressure acting on the lowering brake valve through the control line, there can be provided two hydraulic resistors, preferably orifice plates of different diameter, which are provided in parallel to one another, of which the larger hydraulic resistor or the orifice plate with the smaller diameter can be switched via a switching possibility between an activated state and a deactivated state, wherein these two hydraulic resistors or orifice plates open into the control line via a change-over valve. A finer control is possible as a result.

For the switch between internal and external control of the control pressure acting on the lowering brake valve through the control line, there can also be provided a change-over between two orifice plates of different diameter which are connected to a 3/2 way valve and are provided in parallel to one another.

Here, it is possible in each case for the value of the smaller hydraulic resistance to be 0.6 times the value of the larger hydraulic resistance diameter or for the diameter of the smaller orifice plate to be 0.6 times the diameter of the larger orifice plate. As a departure, however, all ratio values from 0 to 1 are possible.

In addition, a nonreturn valve can further be provided in the line section with the smaller hydraulic resistance, in particular with the larger orifice plate, through which nonreturn valve flow can pass only in the direction from the smaller hydraulic resistance, in particular the larger orifice plate, to the 3/2-way valve.

The external control can preferably be assigned a dedicated pump from which it is supplied. The external control can also be connected to the drive machine designed as a pump.

BRIEF DESCRIPTION OF THE DRAWINGS

Exemplary embodiments of the invention which are illustrated in the drawings are explained hereinbelow. In the drawings.

Corresponding reference signs are used for like or identical components in all the figures.

DETAILED DESCRIPTION OF THE PREFERRED EMBODIMENT(S)

Figure 1:
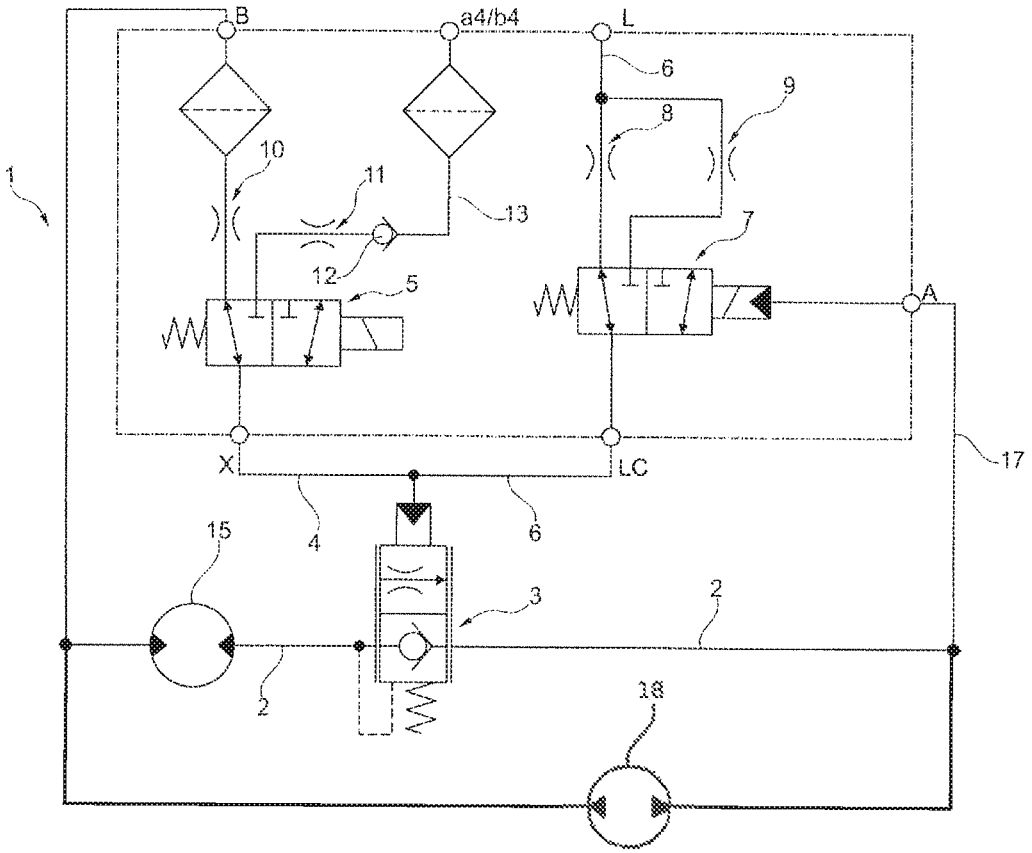
FIG. 1 shows a first exemplary embodiment of a hydraulic controller according to the invention.

FIG. 1 shows a hydraulic controller 1 for a hydraulically activated hook (not illustrated in the drawing) which belongs to a crane and can be lifted and lowered by means of a winch 16. Here, the hydraulic system (not illustrated in more detail in this respect) has at least one working machine 15, which is designed as a hydraulic motor, and at least one drive machine 18, which is designed as a pump. The working machine 15 is drivingly mechanically coupled to the winch 16 to drive the winch 16 of the crane. The working machine 15 is connected directly or indirectly to at least one drive machine 18 by means of two connections via corresponding working lines 2, which connections serve as a feed or return depending on the operating state of the working machine 15.

In the working line 2, which serves as a return during lowering, there is provided—as illustrated in FIG. 1—a lowering brake valve 3 which is connected to the other work line 2 via a control line 4 in such a way that the lowering brake valve 3 is displaceable against a restoring force by the control pressure, which prevails in this other working line 2 and is forwarded via the control line 4, from the blocking position of said valve into a through-flow position for lowering the hook by means of the winch 16, in particular a primary winch.

For an adjustment of the control pressure acting on the lowering brake valve 3 to different values, the control line 4 is provided with a control switch 5 for switching between internal and external control. For this purpose, an outflow line 6 leading back to the tank (not illustrated in the drawing) branches off from the control line 4 between the control switch 5 and the lowering brake valve 3, in which outflow line there is further provided an orifice switch 7 pertaining to first and second hydraulic resistors 8, 9 in the form of first and second orifice plates 8, 9 of different diameters that are provided in parallel to one another. Specifically, a diameter of the first orifice plate 8 is larger than the diameter of the second orifice plate 9. In other words, the first and second hydraulic resistors 8, 9 have different constant hydraulic resistances.

Here, it is possible to switch between the first orifice plate 8 and the second orifice plate 9 via the orifice switch 7, which is formed by a 3/2-way valve, wherein fast lowering of the hook occurs with the smaller second orifice plate 9 and more stable operation with slow lowering of the hook occurs with the larger first orifice plate 8, and wherein, furthermore, the signal of the external control is limited in such a way that complete opening of the lowering brake valve 3 is not possible. Here, the diameter of the smaller second orifice plate 9 is about 0.66 times the diameter of the larger first orifice plate 8.

A fraction of the pressure is channeled away through the outflow line 6 leading back to the tank, with the result that the pressure acting on the lowering brake valve 3 is reduced by this fraction. If the larger orifice plate 8 is operated in the outflow line 6 leading back to the tank, a greater feed-through results, with the result that the control pressure acting on the lowering brake valve 3 is reduced and lowering takes place more slowly.

The control switch 5 for switching between internal and external control is formed by a 3/2-way valve. A nonreturn valve 12 is further provided in a line section 13 with the larger orifice plate 11, through which nonreturn valve flow can pass only in the direction from the larger orifice plate 11 to the 3/2-way valve.

A supplemental control line 17 connects the working line 2 which serves as a return during the prevailing operating state of the working machine 15 to the orifice switch 7 for loading the orifice switch 7 by the back pressure which, on account of the line resistance, results in the working line 2 which serves as a return during the prevailing operating state of the working machine 15.

Figure 2:
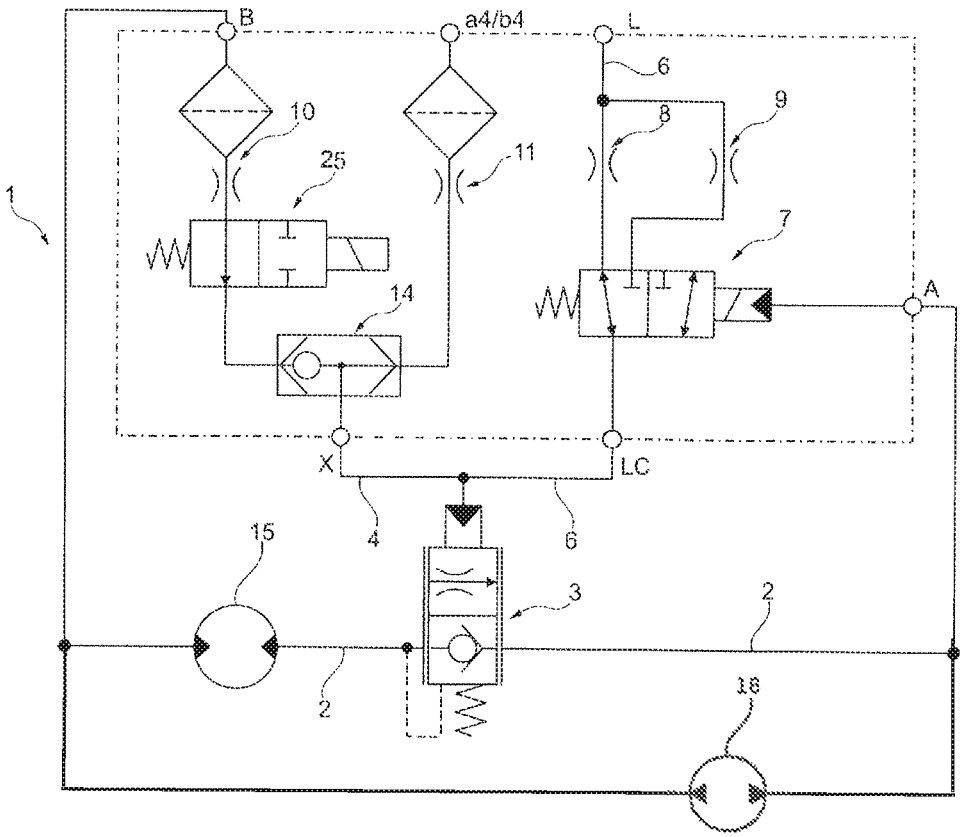
FIG. 2 shows a second exemplary embodiment of a hydraulic controller according to the invention.

In the further exemplary embodiment illustrated in FIG. 2, the switch between internal and external control of the control pressure acting on the lowering brake valve 3 through the control line 4 is achieved in a different way via third and fourth hydraulic resistors 10, 11 in the form of third and fourth orifice plates 10, 11 of different diameter which are provided in parallel to one another. In other words, the third and fourth hydraulic resistors 10, 11 have different constant hydraulic resistances. The third and fourth orifice plates 10, 11 are hydraulically connected to (or open into) the control line 4 via a change-over valve 14 which switches in dependence on the prevailing pressures between the third orifice plate 10 and the fourth orifice plate 11. Specifically, a diameter of the third orifice plate 10 is smaller than the diameter of the fourth orifice plate 11. Here, the diameter of the smaller orifice plate 10 is 0.6 times the diameter of the larger orifice plate 11.

The change-over valve 14 is "actuated" by a control switch 25 and the pressure which acts depending on the switching state of the control switch 25. In the further exemplary embodiment illustrated in FIG. 2, the control switch 25 is in the form of a 2/2-way valve.

Figure 3:
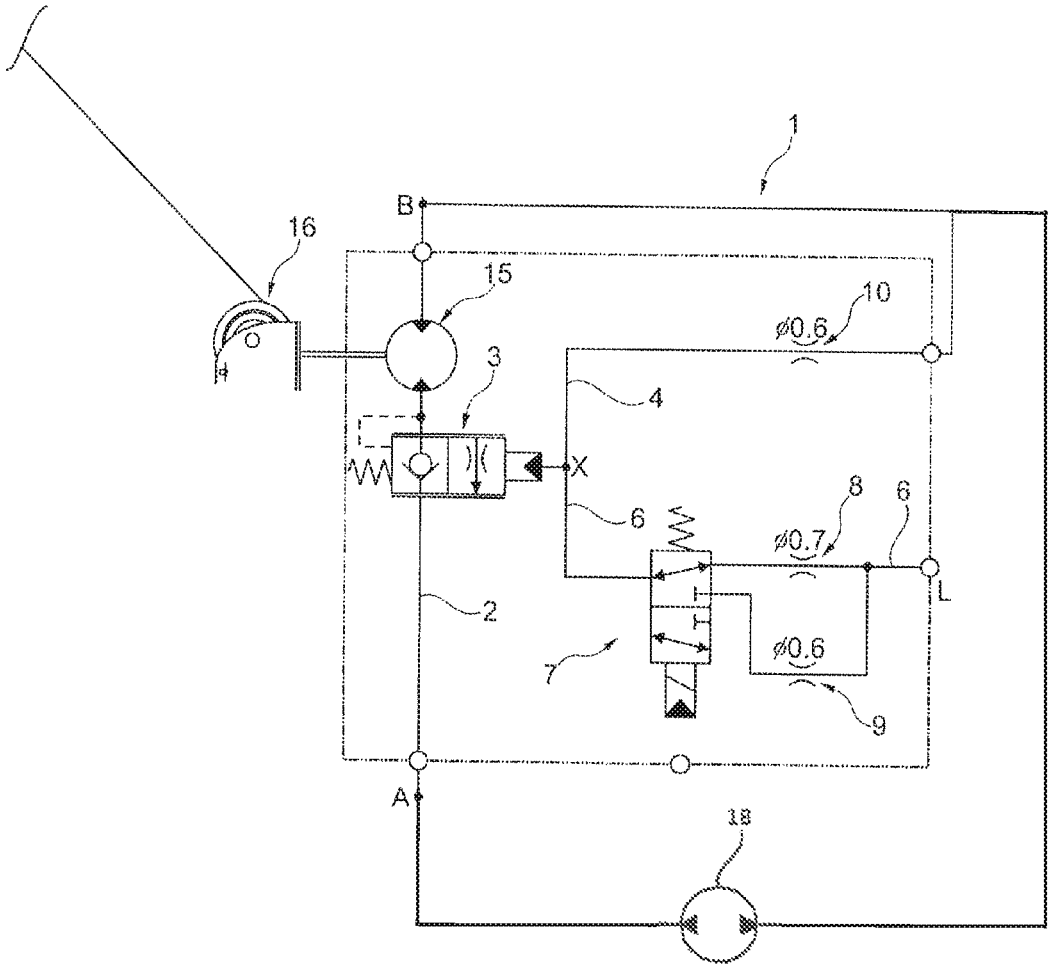
FIG. 3 shows a third exemplary embodiment of a hydraulic controller according to the invention.

The third exemplary embodiment shown in FIG. 3 shows a simplified version of the subject matter according to FIG. 1, wherein the switch between internal and external control that is shown in FIG. 1 is dispensed with and, instead, merely a fixed orifice plate 10 is provided. In addition, a drive machine 15 and a winch 16 actuated thereby are shown.

Figure 4:
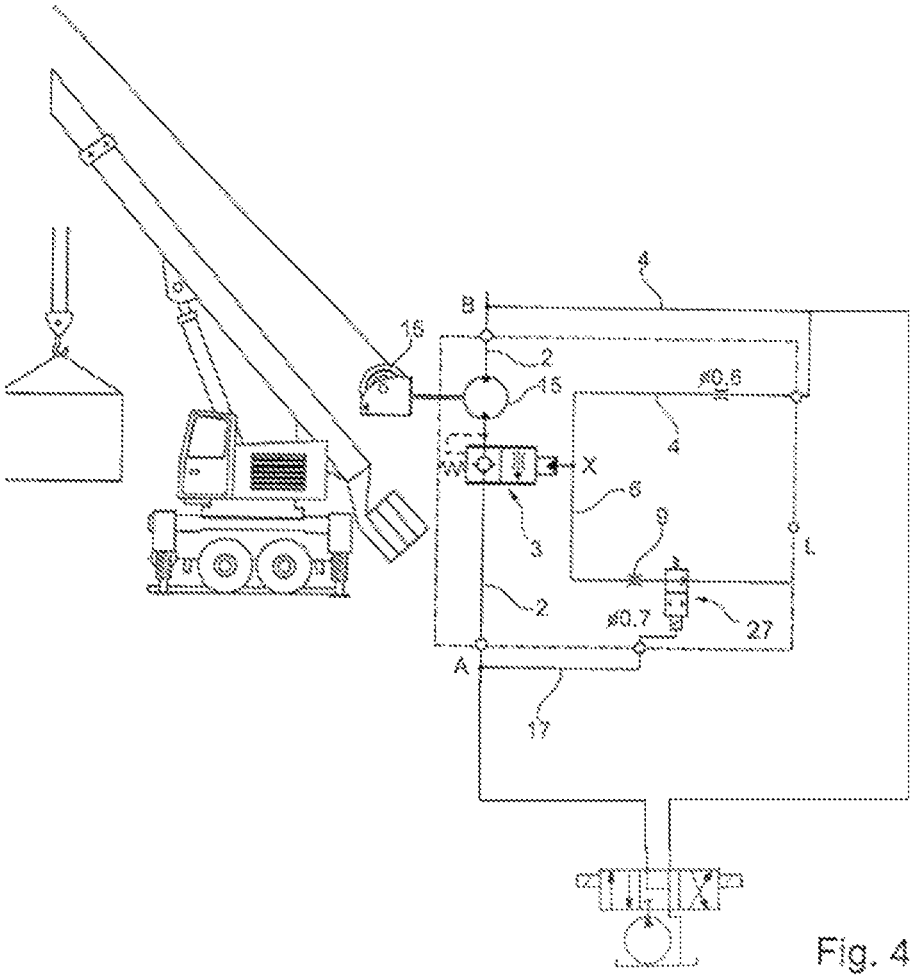
FIG. 4 shows a fourth exemplary embodiment of a hydraulic controller according to the invention.

The fourth exemplary embodiment shown in FIG. 4 shows an alternative design, wherein an orifice switch 27 is provided in the outflow line 6. The orifice switch 27 is designed as a 2/2-way valve by means of which an orifice plate 9 can be activated or deactivated, with the result that the pressure acting on the lowering brake valve 3 can be changed.

Figure 5:
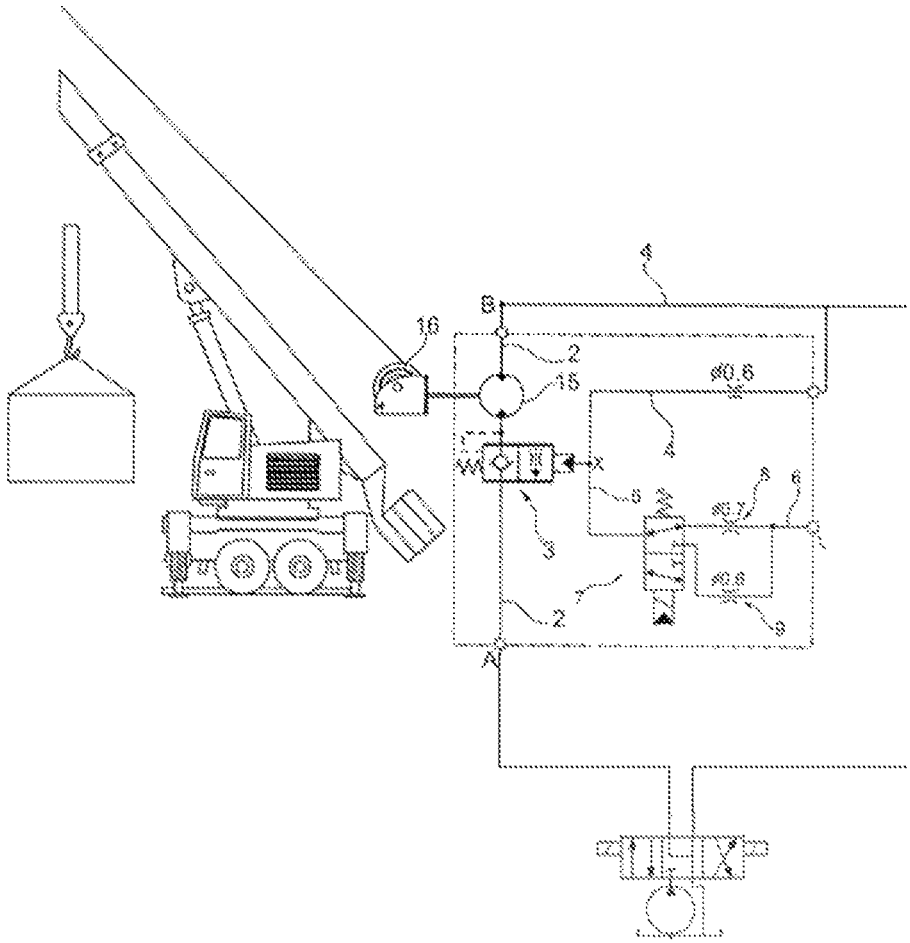
FIG. 5 shows a fifth exemplary embodiment of a hydraulic controller according to the invention.

In the variant shown in FIG. 5, the hydraulic controller comprises the orifice switch 7, wherein the control line 17 is only indicated and can be loaded arbitrarily, for example electrically, hydraulically, pneumatically or in some other way. The control of the loading can also occur in an arbitrary manner.

Figure 6:
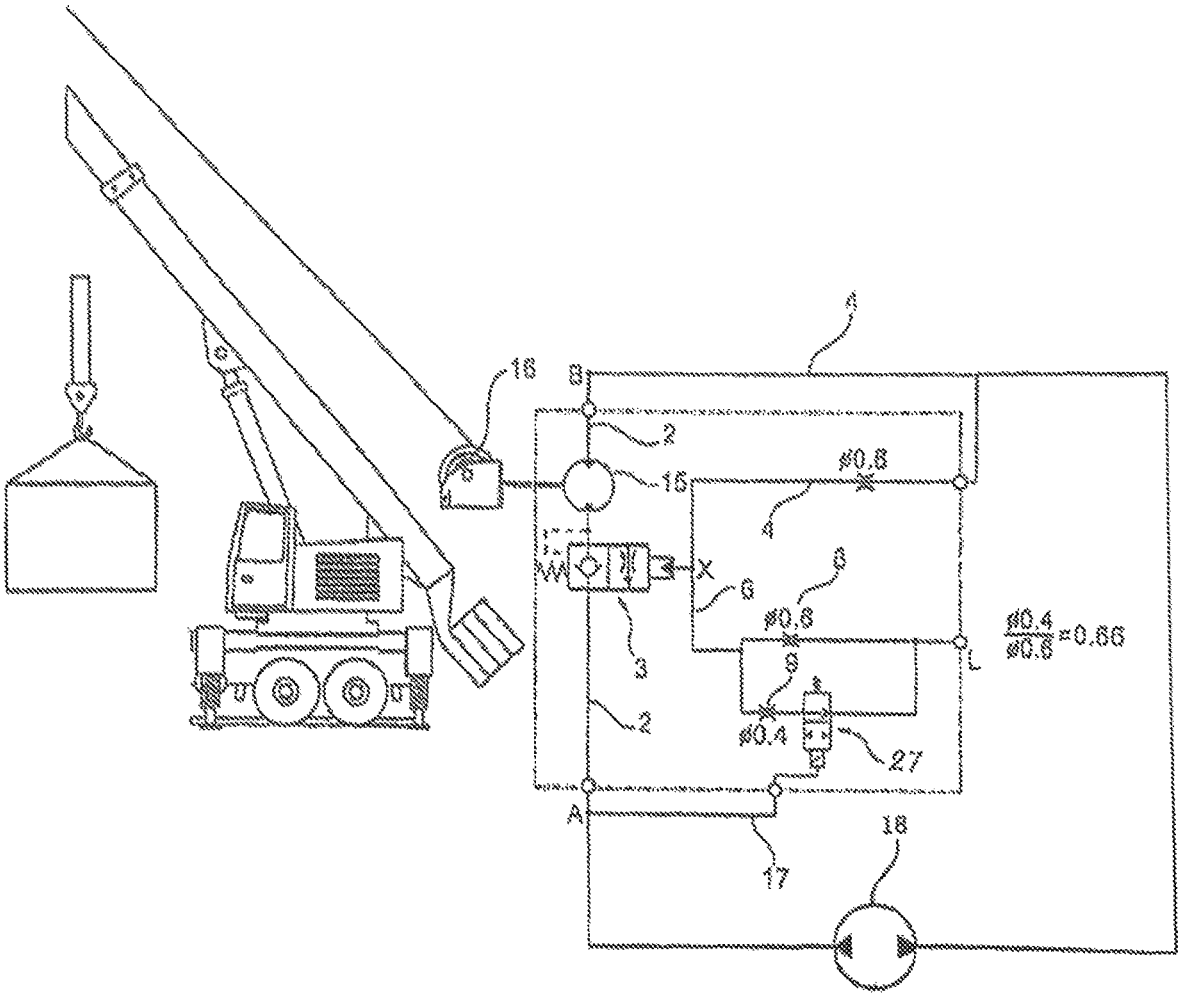
FIG. 6 shows a sixth exemplary embodiment of a hydraulic controller according to the invention.

The variant shown in FIG. 6 is similar to the design of the exemplary embodiment shown in FIG. 4, wherein the orifice switch 27 pertains to two orifice plates 8, 9 of different diameters that are provided in parallel to one another. Here, the orifice plate 9, which has the smaller diameter, can be switched between an activated state and deactivated state via the orifice switch 27 which is formed by a 2/2-way valve, wherein the fast lowering of the hook occurs with the larger orifice plate 8 (and deactivated smaller orifice plate 9) and more stable operation with the slow lowering of the hook occurs in the activated state of the smaller orifice plate 9.

Figure 7:
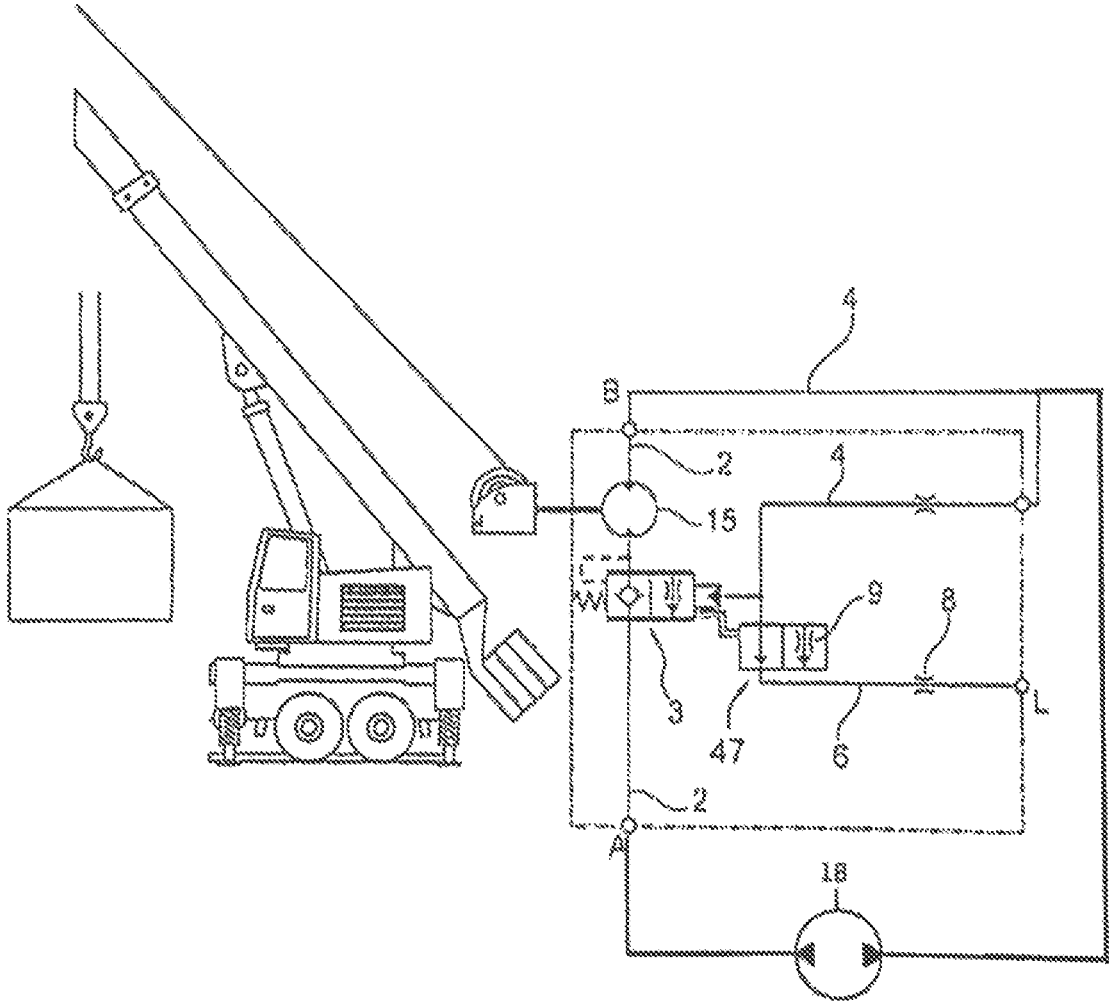
FIG. 7 shows a seventh exemplary embodiment of a hydraulic controller according to the invention.

FIG. 7 shows a modification of the subject matter according to FIG. 6, it being the case here that an orifice switch 47 is configured as a combined component and comprises a switchable hydraulic resistor in the form of the orifice plate 9. Here, the orifice switch 47 is coupled mechanically to the valve path of the lowering brake valve 3. However, the coupling can also be realized, for example, hydraulically or in any other way. As long as the orifice switch 47 is set to "open", the larger orifice plate 8 acts. However, as soon as the smaller orifice plate 9 is connected in series with the larger orifice plate 8 by the orifice switch 47, only the smaller orifice plate 9 acts since it has the greater hydraulic resistance.

The invention claimed is:

1. A hydraulic controller (1) of a hydraulic system for a hydraulically actuated liftable and lowerable hook of a crane, the hydraulic system comprising at least one working machine (15) and at least one drive machine (18), the hydraulic controller (1) comprising:

working lines (2) operably connecting the at least one working machine (15) to the at least one drive machine (18) by two connections, the two connections serving as a feed or return depending on an operating state of the at least one working machine (15);

a control line (4);

a lowering brake valve (3) provided in one of the working lines (2) and connected to the other of the working lines (2) via the control line (4) in such a way that the lowering brake valve (3) is displaceable against a restoring force by a control pressure present in the other of the working lines (2) and forwarded via the control line (4), the lowering brake valve (3) is displaceable from a blocking position of the lowering brake valve (3) into a through-flow position for lowering the hook by a winch (16) drivingly coupled to the at least one working machine (15);

an outflow line (6) leading back to a tank branches off from the control line (4);

an orifice switch (7, 27, 37, 47) provided in the outflow line (6), the orifice switch (7, 27, 37, 47) configured to change an effective hydraulic resistance in the outflow line (6) to at least two different values by open-loop or closed-loop control for an adjustment of the control pressure acting on the lowering brake valve (3) to different values providing fast or slow lowering of the hook; and first and second hydraulic resistors (8, 9) of different hydraulic resistances, which are provided in parallel to one another in the outflow line (6), wherein the first hydraulic resistor (8) is always active and the second hydraulic resistor (9) is connected to the orifice switch (7, 27, 37, 47), wherein the second hydraulic resistor (9) is switchable by the orifice switch (7, 27, 37, 47) between an activated state and a deactivated state of the second hydraulic resistor, wherein the activated state of the second hydraulic resistor (9) corresponds to the slow lowering of the hook, and wherein the deactivated state of the second hydraulic resistor corresponds to the fast lowering of the hook.

2. The hydraulic controller (1) as claimed in claim 1, wherein one of the working lines (2) serving as a feed during a prevailing operating state of the at least one working machine (15) is loaded with a volumetric flow which controls a working speed during lowering of the hook, and wherein the working speed of at least one working machine (15) is changeable at least in certain operating states.

3. The hydraulic controller (1) as claimed in claim 1, wherein the orifice switch (47) is configured as a combined component and comprises the second hydraulic resistor in the form of a switchable hydraulic resistor.

4. The hydraulic controller (1) as claimed in claim 3, wherein the orifice switch (47) is coupled to the lowering brake valve (3).

5. The hydraulic controller (1) as claimed in claim 1, wherein the orifice switch (7, 27, 37, 47) is coupled to the lowering brake valve (3).

6. The hydraulic controller (1) as claimed in claim 1, further comprising a supplemental control line (17) that connects the working line (2) serving as a return during a prevailing operating state of the at least one working machine (15) to the orifice switch (27, 37) for loading the orifice switch (27, 37) by a back pressure.

7. The hydraulic controller (1) as claimed in claim 1, wherein a value of a hydraulic resistance of the first hydraulic resistor (8) is 0.66 times or 0.85 times the value of the hydraulic resistance of the second hydraulic resistor (9).

8. The hydraulic controller (1) as claimed in claim 1, further comprising a third hydraulic resistor (10) and a fourth hydraulic resistor (11) arranged in parallel to one another and having different hydraulic resistances, wherein the third and fourth hydraulic resistors (10, 11) are provided for switching between internal and external control of the control pressure acting on the lowering brake valve (3) through the control line (4), wherein the third hydraulic resistor (10) is switchable between an activated state and deactivated state via a control switch (5, 25), and wherein the third and fourth hydraulic resistors (10, 11) are connected to the control line (4) via a change-over valve (14).

9. The hydraulic controller (1) as claimed in claim 8, wherein the change-over valve (14) carries out a change-over between the third and fourth hydraulic resistors (10, 11) which are arranged on the control switch (5), and wherein the control switch (5) is in the form of a 3/2-way valve.

10. The hydraulic controller (1) as claimed in claim 8, wherein a value of a hydraulic resistance of the fourth hydraulic resistor (11) is 0.66 times or 0.85 times the value of the hydraulic resistance of the third hydraulic resistor (10).

11. The hydraulic controller (1) as claimed in claim 8, further comprising a nonreturn valve (12) in a line portion (13) with a smaller hydraulic resistance, wherein a hydraulic flow through the nonreturn valve passes only in the direction from the smaller hydraulic resistance to the control switch (5), and wherein the control switch (5) is in the form of a 3/2-way valve.

12. The hydraulic controller (1) as claimed in claim 8, wherein the external control is connected to the at least one drive machine (18).

13. The hydraulic controller (1) as claimed in claim 1, wherein the at least one working machine (15) is a hydraulic motor.

14. The hydraulic controller (1) as claimed in claim 13, wherein the at least one drive machine (18) is a hydraulic pump.

15. A hydraulic controller (1) of a hydraulic system for a hydraulically actuated liftable and lowerable hook of a crane, the hydraulic system comprising at least one working machine (15) and at least one drive machine (18), the hydraulic controller (1) comprising:

working lines (2) operably connecting the at least one working machine (15) to the at least one drive machine (18) by two connections, the two connections serving as a feed or return depending on an operating state of the at least one working machine (15);

a control line (4);

a lowering brake valve (3) provided in one of the working lines (2) and connected to the other of the working lines (2) via the control line (4) in such a way that the lowering brake valve (3) is displaceable against a restoring force by a control pressure present in the other of the working lines (2) and forwarded via the control line (4), the lowering brake valve (3) is displaceable from a blocking position of the lowering brake valve (3) into a through-flow position for lowering the hook by a winch (16) drivingly coupled to the at least one working machine (15);

an outflow line (6) leading back to a tank branches off from the control line (4); and an orifice switch (7, 27, 37, 47) provided in the outflow line (6), the orifice switch (7, 27, 37, 47) configured to change an effective hydraulic resistance in the outflow line (6) to at least two different values by open-loop or closed-loop control for an adjustment of the control pressure acting on the lowering brake valve (3) to different values providing fast or slow lowering of the hook, wherein the orifice switch (7) is a 3/2-way valve.

16. A hydraulic controller (1) of a hydraulic system for a hydraulically actuated liftable and lowerable hook of a crane, the hydraulic system comprising at least one working machine (15) and at least one drive machine (18), the hydraulic controller (1) comprising:

working lines (2) operably connecting the at least one working machine (15) to the at least one drive machine (18) by two connections, the two connections serving as a feed or return depending on an operating state of the at least one working machine (15);

a control line (4);

a lowering brake valve (3) provided in one of the working lines (2) and connected to the other of the working lines (2) via the control line (4) in such a way that the lowering brake valve (3) is displaceable against a restoring force by a control pressure present in the other of the working lines (2) and forwarded via the control line (4), the lowering brake valve (3) is displaceable from a blocking position of the lowering brake valve (3) into a through-flow position for lowering the hook by a winch (16) drivingly coupled to the at least one working machine (15);

an outflow line (6) leading back to a tank branches off from the control line (4);

first and second hydraulic resistors (8, 9) of different constant hydraulic resistances, which are provided in the outflow line (6) in parallel to one another in the outflow line (6); and an orifice switch (7, 27, 37, 47) provided in the outflow line (6), the orifice switch (7, 27, 37, 47) configured to change an effective hydraulic resistance in the outflow line (6) to at least two different values by open-loop or closed-loop control for an adjustment of the control pressure acting on the lowering brake valve (3) to different values providing fast or slow lowering of the hook.

* * * * *